US007201556B2

(12) United States Patent
Loftus

(10) Patent No.: US 7,201,556 B2
(45) Date of Patent: Apr. 10, 2007

(54) DISPLACEMENT CASING

(75) Inventor: Peter Loftus, Derby (GB)

(73) Assignee: Rolls-Royce plc, London (GB)

( * ) Notice: Subject to any disclaimer, the term of this patent is extended or adjusted under 35 U.S.C. 154(b) by 143 days.

(21) Appl. No.: 10/725,180

(22) Filed: Dec. 2, 2003

(65) Prior Publication Data

US 2004/0120809 A1 Jun. 24, 2004

(30) Foreign Application Priority Data

Dec. 20, 2002 (GB) ..... 0229702.6

(51) Int. Cl.
*F01D 11/22* (2006.01)
*F01D 11/24* (2006.01)

(52) U.S. Cl. ..... 415/14; 415/1; 415/13; 415/118; 415/126; 415/128; 415/173.2; 415/173.3

(58) Field of Classification Search ..... 415/1, 415/13, 14, 118, 126, 127, 128, 173.2, 173.3
See application file for complete search history.

(56) References Cited

U.S. PATENT DOCUMENTS 3,227,418 A * 1/1966 West ..... 415/127
4,330,234 A * 5/1982 Colley ..... 415/173.2
4,384,819 A * 5/1983 Baker ..... 415/14
5,012,420 A 4/1991 Walker
6,152,685 A 11/2000 Hagi
6,273,671 B1 * 8/2001 Ress, Jr. ..... 415/1

FOREIGN PATENT DOCUMENTS

EP 578285 A1 * 1/1994 ..... 415/14
GB 2 104 966 A 3/1983
JP 62-75001 A * 4/1987 ..... 415/173.2
JP 6-137106 A * 5/1994 ..... 415/173.2
SU 0 757 749 AB 8/1980

* cited by examiner

*Primary Examiner*—Christopher Verdier
(74) *Attorney, Agent, or Firm*—Manelli Denison & Selter PLLC

(57) ABSTRACT

A rotor system is provided whereby a rotary assembly such as a fan blade combination in a jet engine is brought into rub contact with a casing such that sensors detect vibration. The casing is then retreated in order to open the gap to a desired value for engine performance. In such circumstances, the rub contact position is defined as a base datum reference from which distance the casing is displaced in order to provide the specified gap for engine performance and efficiency.

20 Claims, 4 Drawing Sheets

DISPLACEMENT CASING

FIELD OF THE INVENTION

The present invention relates to rotor systems and more particularly to rotor to casing clearance control systems used in jet engines.

BACKGROUND OF THE INVENTION

The attached drawing marked "Prior Art" illustrates in schematic longitudinal cross-section a typical jet engine EN configuration. A number of rotary or, in this illustration, blade sections A, B, C, D, are provided at different functional stages within the engine EN. Operation of a jet engine EN is relatively well known and clearly as illustrated involved airflows (shown by arrowheads) in order to create propulsion through combustion derived by operation of the engine EN. One of the determinant factors with respect to engine operation efficiency is the amount of leakage of airflows about tips of the blades in comparison with flows through and across the blades of the engine stages A, B, C, D. A particular area of leakage is that about the distal spinning tip end of each blade. However, it is necessary to provide some clearance between the distal or tip end of each blade and a casing or cowling within which the blades rotate. It is of particular importance that the gap should be predictable rather than absolutely minimised. As the blades rotate they define a tip edge profile which is spaced by the gap from the casing.

It will be understood that it is generally an objective to achieve as small tip clearance as possible throughout an engines operational cycle, but particularly during normal engine operation, such as at cruise. The engine operates in the cruise state for the longest periods of time and so the advantages of well regulated tip clearance will therefore be beneficial.

SUMMARY OF THE INVENTION

In accordance with the present invention there is provided a rotor system comprising a rotary assembly within a casing with a gap between a tip edge of the rotary assembly and the casing, means to close the gap until rub contact between the tip edge and the casing and means to detect rub contact whereupon control means act to open the gap to a desired value.

Typically, the means to detect rub contact is by detection of vibration.

Typically, the rotary assembly is formed from compressor or turbine blades secured about a rotary bearing. Normally, multiple stages of blading are provided to form the rotary assembly.

Possibly, the means to close the gap between the rotary assembly and the casing is by constriction of the rotary assembly and/or casing. Such constriction may be radial constriction. Alternatively, constriction of the casing may be by tangential displacement towards the centre of the casing. Constriction of the casing may be through a single constriction cuff or through multiple constriction cuffs to provide respective casing segments between those cuffs. The control means may be arranged to act upon individual casing segments in order to open the gap to the desired value.

Possibly, the means to close the gap between the rotary assembly and the casing is by variable cooling of the rotary assembly and/or the casing in order to precipitate constriction of that rotary assembly or casing until the gap achieves the desired value.

Alternatively, the means to close the gap between the rotary assembly and the casing is by utilising eccentric cam displacement means associated with respective segments of the casing in order that by rotation of said eccentric cam means specified displacement of that segment is achieved to present the desired value of the gap.

Normally, the control means will also control the means to close the gap between the rotary assembly and the casing.

Alternatively, the tip edge of the rotary assembly may be arranged to radially expand by reversing the means to close the gap until rub contact.

Preferably, the means to detect rub contact comprises at least one sensor appropriately located to determined vibration initiation due to rub contact throughout the casing. Advantageously, the means to detect vibration comprises a multiple sensor system for more sensitive operation and/or more rapid determination of rub contact and/or facilitating determination of rub contact position between the tip edge and the casing. Possibly, the control means will act dependent upon the means to detect vibration in order to selectively open the gap to the desired value dependent upon the vibration detected. The desired value and/or speed of opening may depend upon the severity of vibration and/or its frequency and/or any harmonics.

Possibly, the means to detect vibration will allow determination of the point of rub contact by a triangulation technique. This triangulation technique may depend upon the signals received from several vibration sensors or through a consideration of primary (direct) vibration recovery and reflected vibration recovery from reflective surfaces determined by the means to detect vibration as a wave harmonic. The means to detect vibration or the control means may utilise time of flight or propagation determination in order to approximate rub contact position between the tip edge and the casing.

Also in accordance with the present invention there is provided a method of regulating a gap between a rotary assembly and a casing in an engine, the method comprising closing the gap until rub contact between the rotary assembly and the casing, detecting rub contact and opening the gap to a desired value.

Normally, detecting rub contact is by determination of vibration.

Further in accordance with the present invention there is provided an engine including a system as claimed above.

Additionally in accordance with the present invention there is provided an engine operated in accordance with the method described above.

Typically, the system or method as described above will initiate rub contact periodically in order to appropriately set the gap for efficient operation. Possibly, gap determination will be performed at steady, cruise conditions. Generally, the means for detecting vibration will be operational during all periods of system activity such that closing of the gap between the tip edge and the casing other than through the means for closing deliberately that gap can be determined and the control means thereby open the gap as required to avoid detrimental on-going rub contact and abrasion of the tip edge and/or the casing.

Possibly, specific singer areas or elements may be provided in the casing in order to provide distinct vibration response to rub contact. Such distinct vibration from each singer element being determinable by the means to detect vibration and the control means by knowledge of each singer element location being able to determine the location of rub contact. These singer elements or areas being more readily replaceable or providing less abrasion or providing less mutual damage to the tip edge and the bulk of the casing.

BRIEF DESCRIPTION OF THE DRAWINGS

Embodiments of the present invention will now be described by way of example only with reference to the accompanying drawings in which.

DETAILED DESCRIPTION OF THE INVENTION

Figure 1:
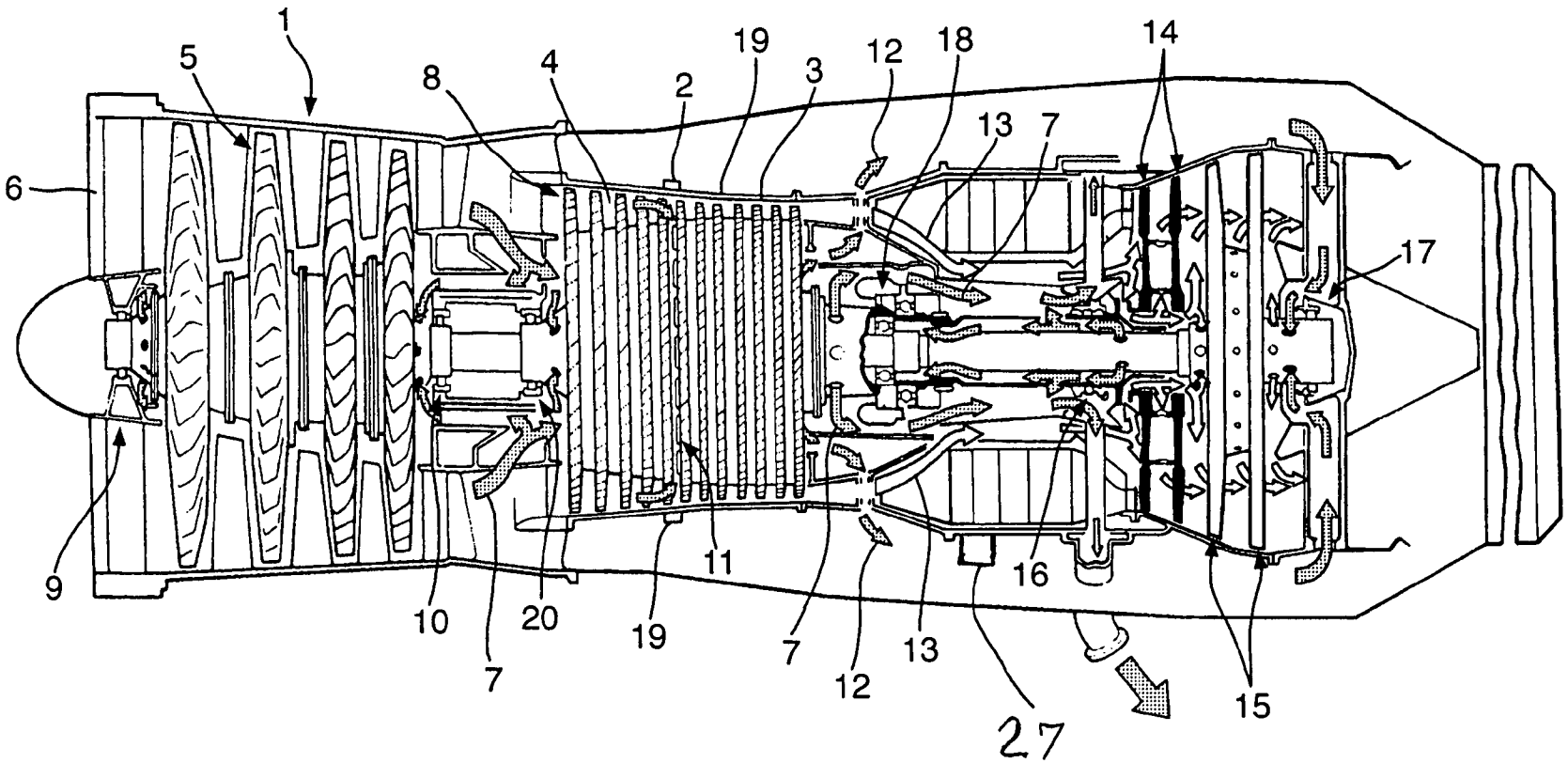
FIG. 1 is a schematic longitudinal cross-section of an engine incorporating a system in accordance with the present invention.

Referring to FIG. 1 showing a longitudinal cross-section of an engine. As can be seen the engine 1 is substantially similar to that depicted as "prior art" except that acoustic detectors 2 are located about a casing 3 within which a rotary assembly 4 comprising banks of fan blades is arranged to rotate. The arrowheads depict airflows within the engine 1 which are substantially conventional in nature. Although described with reference to vibration detection it will be understood that rub contact may also be determined by localised temperature or pressure variations if appropriate sensors are provided and located about the casing 3 at similar positions to those for the acoustic detectors 2.

The engine 1 incorporates a low pressure compressor stage 5 which receives air through an air inlet 6 and directs it (arrowheads 7) to a high pressure compressor stage 8. The low pressure compressor 5 utilises a number of fan blades supported upon a rotary shaft between a front bearing 9 and a rear bearing 10. The airflows (arrowheads 7) are forced and compressed through the high pressure compressor stage 8 and air transfer ports 11 with airflows depicted as arrowheads 12 and arrowheads 13 respectively illustrating intermediate airflow and high pressure airflow. It will be noted that there is also further low pressure airflow through arrowheads 7 which pass through orifices in the rotary shaft in order to provide air cooling. There is a high pressure turbine 14 provided to drive the high pressure compressor stage 8 whilst a low pressure turbine 15 acts through a rotary drive shaft to drive the low pressure compressor stage 5. Respective bearings 16, 17 are provided in order to support and allow rotation of the respective turbines 14, 15. There is also a location bearing assembly 18. The rotary assembly 4 is supported between bearings 18 and 20.

There are a number of rotary members provided in rotary assemblies generally held within cowlings or casings such as casing 3 with a gap between a tip edge constituted by the blades of each rotary assembly and an inner surface of the cowling or casing. As indicated previously, there are significant benefits with respect to engine 1 operating efficiency if the gap between the rotary assembly periphery or tip edge and the casing is closely regulated.

Singer elements or areas 19 may be provided in or on the casing 3. These elements or areas are shaped, configured or formed from material compositions which provide a distinct vibration on rub contact. These individual elements and areas 19 may be specifically identified by the sensors 2 so that the area of rub contact can be determined.

In accordance with the present invention sensors 2 are provided about the surface of the casing 3. It will be appreciated that similar systems could be provided with respective sensors to detect vibration about other rotary assemblies such as the low pressure compressor 5, the high pressure turbine 14 or the low pressure turbine 15. The sensors 2 are generally located in order to detect vibration in the casing and may be tuned in order to avoid specific vibrations for reasons other than in accordance with tip to casing gap regulation through rub contact.

Figure 3:
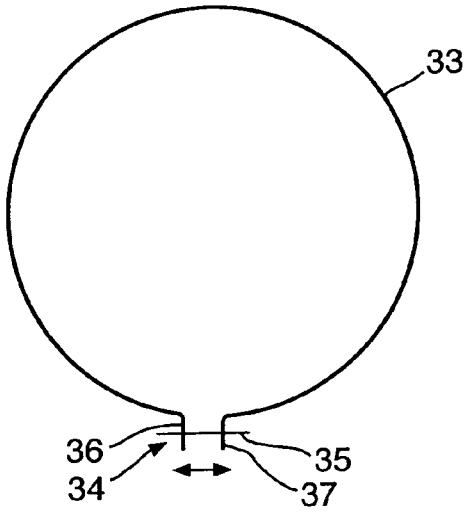
FIG. 3 is a schematic front cross-section of a first casing configuration.
Figure 4:
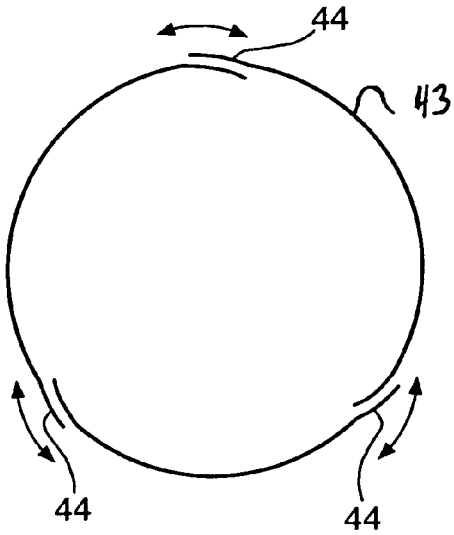
FIG. 4 is a schematic front cross-section of a second casing configuration; and, FIG. 5 is a schematic front cross-section of a third casing configuration.
Figure 5:
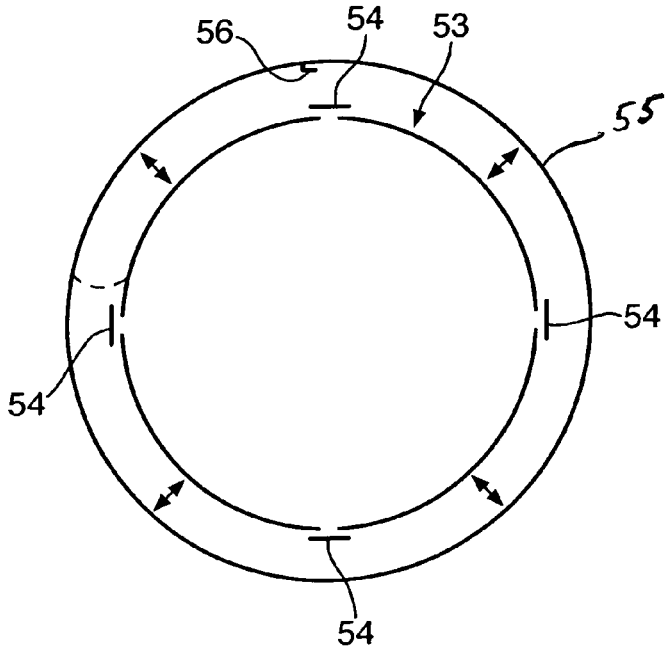
Figure 6:
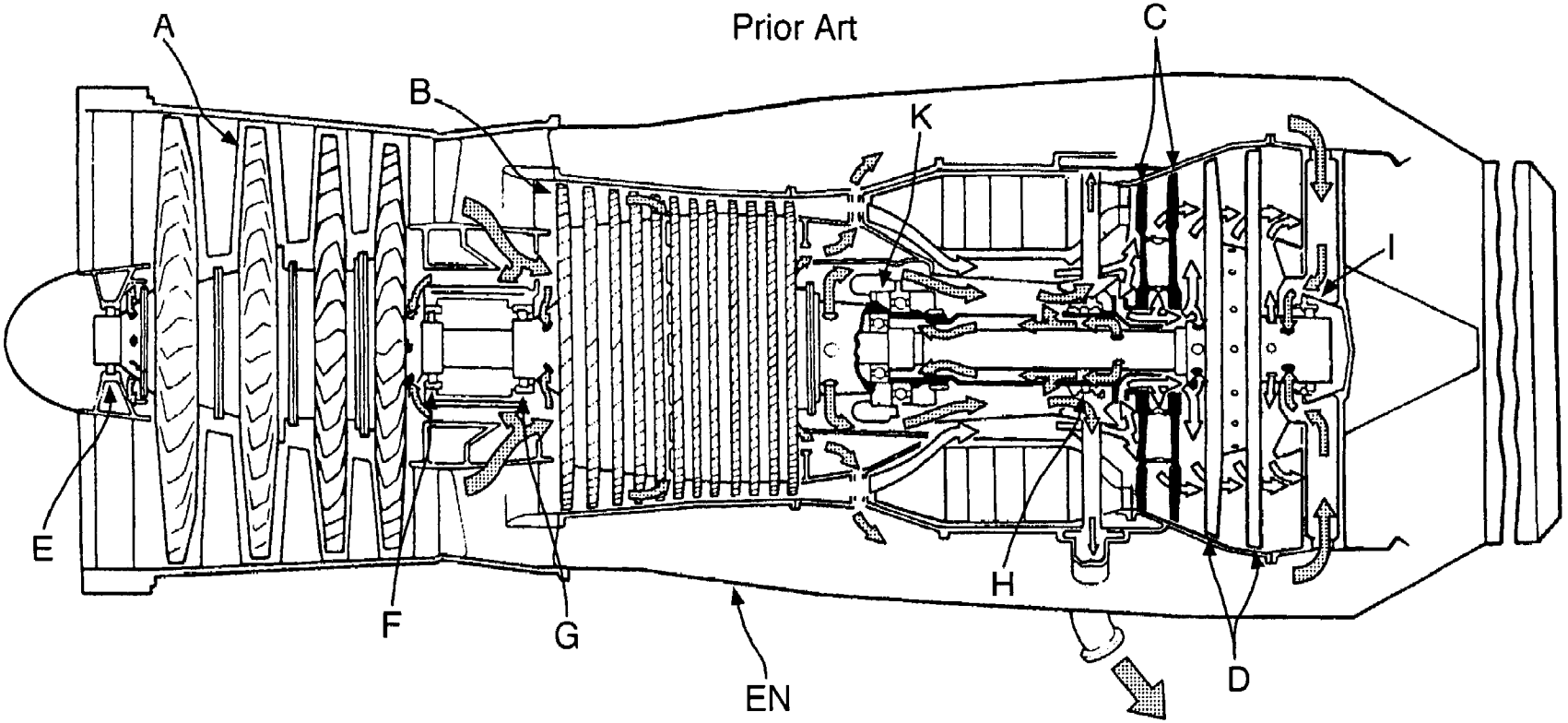
Fig. 6 Prior Art
FIG. 6 is a schematic longitudinal cross-section of a prior engine arrangement.

In accordance with the present invention the casing 3 is displaced inwardly towards the blades and in particular the tips of the blades from which the rotary assembly, in this case the low pressure compressor stage 4, is constructed. This inward displacement or closing of the gap between the blade tips and the casing 3 can be achieved in a number of ways. FIGS. 3 to 5 illustrate schematically three possible configurational approaches to constriction of the casing in order to close the gap but it will also be appreciated that other mechanisms may be used or alternatively the blades of the rotary assembly (low pressure compressor stage 4) could be moved outwards if possible to close the gap.

In FIG. 3 a casing 33 is inwardly constricted through a choke collar junction or cuff 34 in which a regulator screw 35 is turned within screw threads located in lip members 36, 37 in order to narrow the gap between these lip members 36, 37 and therefore reduce the circumference of the casing 33. This constriction is relatively crude with greater inward displacement in side portions of the casing 33 in comparison with about the collar junction or cuff 34 and opposite that junction 34 in the casing 33.

FIG. 4 illustrates a second mechanism for constriction of a casing 43 in which distinct segments of the casing 43 have angled overlap junctions or cuffs 44 such that by rotation of the respective segments the degree of overlap can be increased or reduced to alter the circumference of the casing 43 in the manner of an iris. Thus, in operation the casing 43 would move towards a rotary member (not shown) in order to close the gap between that rotary assembly and the casing 43. Clearly the more overlap junctions 44 provided in the casing 43 the greater control of constriction uniformity and so accuracy. It will also be understood that the overlap junctions 44 will provide a partial seal to the cowling 43 in order to limit airflow leakage through the junctions 44 in comparison with the collar junction 34 described in FIG. 3.

FIG. 5 illustrates a casing 53 in which specific segments of the casing 53 are independently supported and presented such that each segment can be moved inward and away from a centre of the casing 53 in order to constrict that casing 53 and therefore close the gap with a rotary assembly (not shown) located within the casing 53. Normally, cover seals 54 will be provided in order to inhibit leakage through the inherent gap between segments of the casing 53. Such movement of each segment could be achieved by presenting the casing 53 in a closed chamber 55 so that increases or decreases in pressure move the segments. Furthermore, individual segments may be moved by placing a bag (broken lines 56) or otherwise provoking sealed chamber which can be inflated or deflated for each segment.

Figure 7:
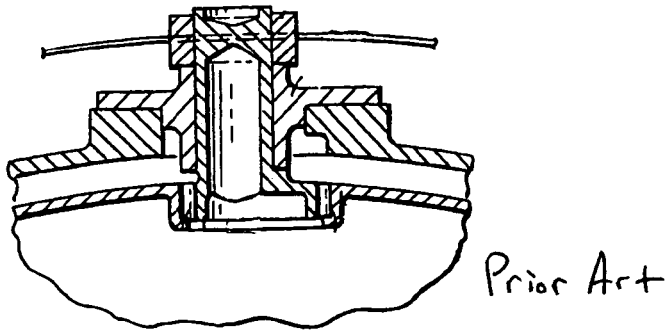
FIG. 7 is a side view of a prior eccentric rotation arrangement.

Alternative means to vary the gap between the rotary assembly and its casing are described in European Patent Publication No. 0790390 (Rolls Royce Plc) and U.S. Pat. No. 4,330,234 (Rolls Royce Ltd). In European Patent Publication No. 0790390 variation in the clearance gap between a rotary assembly and its casing is achieved through additional cooling of a stator disk upon which the elements of the rotary assembly are secured. Such selective cooling of the stator disk allows that disk to contract or expand in order thereby to alter the tip edge clearance created by the elements secured to that stator disk in the rotary assembly and therefore vary the clearance gap between that tip edge or periphery of the rotary assembly and its casing. In U.S. Pat. No. 4,330,234 the casing comprises a number of casing segments supported upon respective eccentric cam mechanisms whereby rotation creates axial displacement of an angularly presented casing segment as illustrated in FIG. 7 of the present specification. Such eccentric rotation thereby alters the angular relationship and therefore clearance gap between a peripheral or tip edge of a rotary assembly beneath the casing segment.

From the description and drawings provided with respect to FIGS. 3 to 5 along with EP0790390 and U.S. Pat. No. 4,330,234 it will be appreciated that the constriction of a casing or other alteration in the clearance gap can be achieved in a number of ways and utilising a range of mechanisms. In general, the more segments provided for the casing the more accurate and controlled will be the constriction of the casing. In accordance with the present invention the degree of closure of the gap between the rotary assembly and the casing will be in the order of a few microns until rub contact. In such circumstances, it will be appreciated that the constriction provided must be accurately controlled and also allow rapid reversal or opening of the gap in order to prevent damage to the rotary assembly and/or the casing through prolonged rub contact between them.

As indicated above, in accordance with the present invention the gap between the rotary assembly and the casing is reduced until there is rub contact therebetween. This rub contact creates vibration in the casing which is detected by the sensors 2 appropriately located about the casing 3. The sensors 2 are in relatively low hazard areas of the engine 1 such that their operation will not be unpredictably or excessively variable dependent upon engine 1 operational state. Although a number of sensors 2 is the preferred arrangement of the present system it may be possible to provide a single sensor which acts to determine vibration due to rub contact at any point between the rotary assembly and casing. Clearly, where the casing is segmented as depicted in FIGS. 4 and 5 it is preferable for there to be at least one sensor for each segment of the casing.

Principally in accordance with the present invention, once rub contact between the rotary assembly and the casing is determined through detection of vibration there will be an immediate opening of the gap to a desired value. This desired value will in principle be determined in order to achieve engine performance or efficiency. It should be noted that the specific gap provided between the rotary assembly and the casing may vary during different engine cycles, for example the gap may be narrower during engine decelerations and wider during engine accelerations. The engine state or required performance will be set by appropriate controls and further sensors and detectors of such parameters as temperature, airflow and fuel consumption.

It will be appreciated that an engine 1 through an operational cycle will be expected to provide different power output as well as be subjected to varying temperatures. These factors will alter component dimensions materially and so in accordance with the present invention typically there will be a gap regulation episode at predetermined time periods or at specific temperature levels in order to ensure that the gap between the rotary assembly and the casing is appropriately set and regulated for best engine performance and efficiency. Clearly, these gap regulation episodes involving closing the gap to rub contact, detecting vibration and retreating to open the gap to a desired value will only occur during periods of relatively stable engine operation. Nevertheless, the means for detection of vibration due to rub contact will be maintained such that if such rub contact is determined during operation a controller can then immediately arrange for gap opening by displacement of the casing or rotary assembly contraction to eliminate such rub contact.

An engine 1 through its life will be subject to wear and mechanical distortion of components due to creep etc. The present regime for gap regulation will allow adjustment of the casing to rotary assembly position to ensure that a desired gap between them is maintained despite such ageing of the engine 1 or at least extend the operational life of that engine 1 between maintenance or service requirements.

Generally provided there is high quality alignment it will be appreciated that the rotary assembly will be centrally located within the casing and so ideally when the gap is closed there would be rub contact throughout the periphery of the rotary member at a tip edge profile formed by the ends of the blades with the inner surface of the casing. However, in practice there will generally be a sag or slight misalignment such that rub contact takes place at a specific position. Identification of that position will enable specific response to be achieved to open the gap at the position of rub contact rather than generally throughout the tip edge and the casing. It will be understood to achieve such specific opening of the gap it will be necessary for each individual segment of the casing to be specifically displaced radially away from the rotary assembly. As indicated previously this can be achieved by an appropriate mechanical linkage or by use of inflation pockets or bags for each individual segment. These bags are inflated or deflated as required against a bias such as a mechanical spring in order to provide segment position as required.

In order to determine specific location of rub contact it will be appreciated that a technique based upon multiple sensor detection will normally be required. Thus, possibly by a triangulation or time of propagation technique it may be possible to identify a specific rub contact location. It will be understood that a high degree of accuracy may not be required as normally the only relative adjustment will be whole casing or possibly single segment displacement. Thus, mere allocation of rub contact to one segment of the casing may be all the accuracy required. This as indicated previously may be through a triangulation or time of flight technique from a number of sensors or alternatively by providing one sensor or a combination of sensors for each individual segment of the casing so that determination of those sensors for that segment in comparison with no detection of vibration in other segments by other sensors can thereby locate the specific point of rub contact and so achieve opening of the gap as required at that locality rather than generally. It will also be understood that a knowledge of reflective surfaces may also allow determination through reflection harmonics by the vibration sensors of rub contact position.

In order to provide a degree of redundancy it is normal practice to provide two or more sensors for a particular vibration determination in the casing such that failure by one sensor will not render the system ineffective. Normally, these sensors will act as a set with polling of vibration determinations to provide confirmation of vibration consistent with rub contact and therefore to ensure that the control means acts to open the gap as required.

Figure 2:
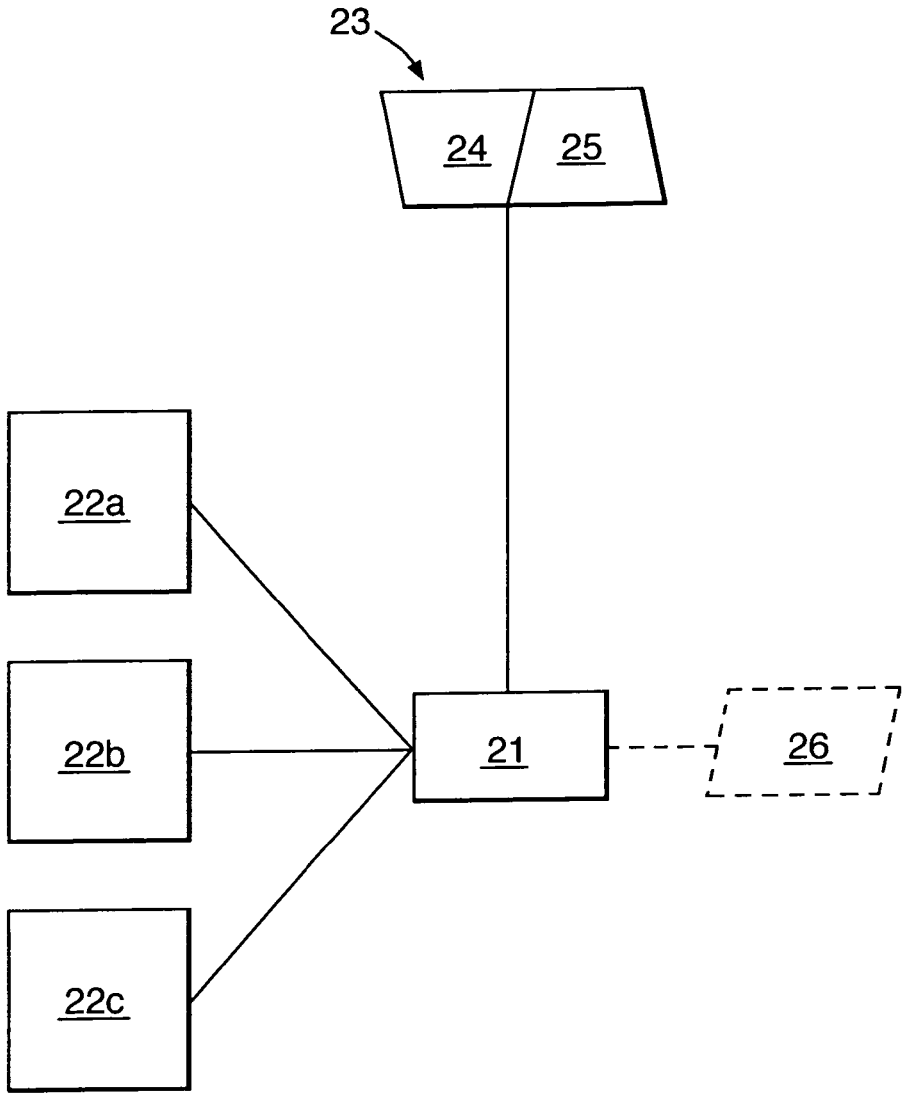
FIG. 2 is a schematic operation diagram of a system in accordance with the present invention.

FIG. 2 illustrates a blade system in accordance with the present invention. Thus, a controller 21 is connected to sensors 22*a*, 22*b*, 22*c* to detect vibration consistent with rub contact between the rotary assembly and the casing. The controller 21 is also connected to a drive 23 which includes gap closing means 24 and gap opening means 25. The drive means 23 as described previously may be a number of mechanical or pneumatic elements for displacing the casing relative to the rotary member in order to close and open the gap therebetween.

In operation, the controller 21 will instruct the drive means 23 such that the gap closing means 24 closes the gap between the casing and the rotary assembly until a point occurs when the sensors 22 detect rub contact and provide an appropriate signal to the controller 21. At this point the controller 21 will then instruct the drive means 23 such that the gap opening means 25 opens the gap to a desired spacing value for efficient engine operation or to achieve a desired performance. This displacement by the gap opening means 25 will be a fixed value determined for that engine operation. Nevertheless, the controller 21 may receive override signals from other inputs 26 (shown in dotted line) which may alter the necessary or desired gap. These other inputs 26 may include engine temperature, desired fuel consumption, airflow rate or other factors.

As indicated, previously the sensors 22 for determination of vibration consistent with rub contact will be appropriately distributed around the casing in order to rapidly detect such rub contact.

It will be appreciated that the gap closing means 24 will generally act relatively slowly in order to ensure that the rub contact is not overly aggressive. The gap will be closed over a relatively long period of time using small increments until rub contact is achieved. However, the gap opening means will generally act relatively quickly in order to relieve the rub contact as soon as possible and so prevent damage or abrasion to the casing or blade tips. Generally, the displacement range for the gap closing means will be in the order of several microns and the eventual desired spacing value will also similarly be only in the order of a few microns. It will be understood that generally the gap between the rotary assembly and the casing will be substantially that required for efficient operation or performance and so the present system is acting to provide a reference datum in use as opposed to that assumed from tolerance stack-up on assembly. Rub contact will be considered as a zero spacing such that the gap opening means 25 will then, dependent upon its accuracy of displacement, provide the specified gap for engine efficiency and performance.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A rotor system comprising a rotary assembly within a casing with a gap between a tip edge of the rotary assembly and the casing, means to close the gap until rub contact between the tip edge and the casing and means to detect rub contact whereupon control means act to open the gap to a desired value wherein the means to close the gap between the rotary assembly and the casing is by constriction of the casing wherein the constriction is through a single cuff.

2. A system as claimed in claim 1 wherein the means to detect rub contact detects the rub contact by detection of vibration.

3. A system as claimed in claim 2 wherein the control means acts dependent upon the means to detect vibration in order to selectively open the gap to the desired value dependent upon the vibration detected.

4. A system as claimed in claim 3 wherein the desired value for the gap and the speed of opening is dependent upon one of the severity of vibration, its frequency and any harmonics in the vibration detected by the means to detect vibration.

5. A system as claimed in claim 1 wherein the rotary assembly is formed from any one of the group comprising compressor or turbine blades secured about a rotary bearing.

6. A system as claimed in claim 5 wherein the blades are formed into a cascade of blade rows in order to provide the rotary assembly.

7. A system as claimed in claim 1 wherein the constriction is radial.

8. A system as claimed in claim 1 wherein the control means also controls the means to close the gap between the rotary assembly and the casing.

9. A system as claimed in claim 1 wherein the means to detect rub contact comprises at least one sensor appropriately located to determine rub contact throughout the casing.

10. A system as claimed in claim 1 wherein the means to detect rub contact comprises a multiple sensor system for more sensitive operation, for more rapid determination of rub contact and to facilitate the determination of rub contact position between the tip edge and the casing.

11. A system as claimed in claim 1 wherein the means to detect rub contact will allow determination of the point of rub contact by a triangulation technique.

12. A system as claimed in claim 11 wherein the triangulation technique depends upon signals received from several vibration sensors or through a consideration of primary vibration recovery and reflected vibration recovery from reflective surfaces determined by the means to detect vibration as a wave harmonic wherein the means to detect rub contact detects the rub contact by detection of vibration.

13. A system as claimed in claim 1 wherein the means to detect rub contact for the control means may utilise time of flight or propagation determination in order to approximate rub contact position between the tip edge and the casing.

14. A system as claimed in claim 1 wherein specific singer areas or elements are provided in the casing in order to provide distinct rub contact responses to rub contact which can be determined by the means to detect rub contact and the control means.

15. A system as claimed in claim 14 wherein such distinct responses from each singer element are determinable by the means to detect rub contact and the control means by knowledge of each singer element location being utilised to determine the approximate location of rub contact between the tip edge and the casing.

16. A system as claimed in claim 14 wherein the singer elements are more readily replaceable or provide less abrasion or provide less mutual damage to the tip edge and the casing during rub contact.

17. An engine including a system as claimed in claim 1.

18. A rotor system comprising a rotary assembly within a casing with a gap between a tip edge of the rotary assembly and the casing, means to close the gap until rub contact between the tip edge and the casing and means to detect rub contact whereupon control means act to open the gap to a desired value wherein the means to close the gap between the rotary assembly and the casing is by constriction of the casing wherein the constriction is through multiple constriction cuffs to provide respective casing segments between those cuffs, each individual casing segment being displaceable in order to provide constriction of the casing.

19. A system as claimed in claim 18 wherein the control means is arranged to act upon individual casing segments in order to open the gap to the desired value.

20. A system as claimed in claim 18 wherein the constriction is by tangential displacement towards the center of the casing.

* * * * *